United States Patent [19]

Slee

[11] Patent Number: 4,864,985

[45] Date of Patent: Sep. 12, 1989

[54] ROTARY VALVE

[75] Inventor: Roger H. Slee, Warwick, England

[73] Assignee: AE PLC, Rugby, England

[21] Appl. No.: 184,393

[22] Filed: Apr. 20, 1988

[30] Foreign Application Priority Data

Apr. 21, 1987 [GB] United Kingdom ..... 8709376

[51] Int. Cl.[4] ..... F01L 7/00

[52] U.S. Cl. ..... 123/190 BA; 123/80 BA

[58] Field of Search ..... 123/190 BA, 190 BB, 123/190 B, 80 BA

[56] References Cited

U.S. PATENT DOCUMENTS

| | | | |
|---|---|---|---|
| 3,911,878 | 10/1975 | Hoffbauer et al. | 123/80 BB |
| 3,945,364 | 3/1976 | Cook | 123/80 BA |
| 4,019,488 | 4/1977 | Kremer | 123/190 BA |
| 4,143,517 | 3/1979 | Compton | 123/675 |
| 4,392,460 | 7/1983 | Williams | 123/190 BA |
| 4,517,938 | 5/1985 | Krüger | 123/190 E |
| 4,612,886 | 9/1986 | Hansen et al. | 123/190 B |

FOREIGN PATENT DOCUMENTS

| | | |
|---|---|---|
| 194041 | 9/1986 | European Pat. Off. . |
| 187068 | 10/1922 | United Kingdom . |
| 395543 | 7/1933 | United Kingdom . |
| 530934 | 12/1940 | United Kingdom . |
| 549857 | 12/1942 | United Kingdom . |

*Primary Examiner*—E. Rollins Cross

*Attorney, Agent, or Firm*—William R. Hinds

[57] ABSTRACT

A rotary valve is described together with engines embodying such valves. A rotary valve for an internal combustion engine or compressor comprises a generally cylindrical valve body member of a ceramic material, the valve body having at least one gas duct passing through the valve body wall to communicate with an axially extending passage which is closed at one end and open at the opposite end and at least one channel formed in the valve body wall surface for the passage of gas. Examples of engines embodying the rotary valve in a V-8 cylinder block and in the cylinder head of an in-line four cylinder engine are given.

7 Claims, 3 Drawing Sheets

ROTARY VALVE

The present invention relates to valves for internal combustion engines or compressors and particularly to valves of the type known generically as rotary valves.

Induction and exhaust valves having a rotary or semi-rotary motion instead of the reciprocating motion of the poppet valve are well known.

Such valves have several advantages. They have apparent simplicity, quiet operation, do not need the additional components required to operate poppet valves and there is ease of assembly.

Conical and cylinder forms of rotary valve situated in the cylindrical head of an internal combustion engine allow high levels of power to be achieved by virtue of their favourable valve-time-areas and high permissible engine speeds. Examples of such valves are the well known Cross and Aspin types.

Rotary valves have been used in some automotive applications and also in piston aero engines. The problem with rotary valves and which no-one has yet solved is that of excessive oil consumption especially under low-speed, light-load operating conditions.

Known rotary valves require that the mutally co-operating faces of the valve itself and the housing in which it runs be separated from each other by an oil film to prevent seizure or galling. The necessary running clearance and the oil film inevitably lead to excessive oil consumption at light load.

Rotary valves require much precision machining to ensure adequate sealing and adequate conformity of surfaces. In extreme cases a separate phased loading mechanism is employed to minimise rubbing friction effects.

Heretofore metals have mainly been used for the construction of rotary valves. With metals it is usual that a significant cold clearance will exist between the valve and its housing to ensure that an acceptable level of gas sealing is achieved in the hot condition. Sealing loss arises from differences in temperature between valve and housing and differences in coefficient of thermal expansion between materials. If, for example, a steel valve is used in an aluminium cylinder head the loss of sealing attributable to these factors may be considerable.

The present invention seeks to overcome many of these disadvantages.

According to one aspect of the present invention, a rotary value for gas-aspirated reciprocating piston equipment comprises a generally cylindrical value body member of a ceramic material, the body having an axially extending internal exhaust passage, the passage being closed at one end and open at the opposite end, at least one exhaust duct passing in a generally radial direction through the value body so as, when mounted in such reciprocating piston equipment, to permit exhaust gas from an associated cylinder to communicate intermittently with the internal exhaust passage, and at least one channel formed in the outer surface of the value body so as, when mounted in such reciprocating piston equipment, to permit intermittent entry of inlet gas into the associated cylinder, whereby in use, exhaust gas passing through the exhaust passage heats and thermally expands the value body member so as to tend to maintain a small positive clearance thereabout.

The internal passage in the value body is preferably coaxially disposed with regard to the outer diameter of the value. The internal passage effectively constitutes and, therefore, replaces the conventional exhaust manifold of an engine and may, therefore, reduce the cost and the physical volume, known as the box volume, which the engine occupies.

It has been discovered that by venting the exhaust gasses through the centre of the valve body that thermal expansions between the valve body and its housing may be more evenly matched. In, for example, an internal combustion engine having a conventional water-cooled aluminium alloy cylinder block which has a coefficient of linear thermal expansion in the region of 18 to $21\times10^{-6}$ mm/°C. the running temperature will be about 90° C. Thus, the change in dimension of say a 50 mm bore will be about 0.094 mm. To achieve a similar dimensional change, a silicon nitride valve body having a comparable diameter but with a coefficient of linear thermal expansion of $3\times10^{-6}$ mm/°C. would require a temperature rise of about 600° C. Since the valve is conducting away the hot exhaust gasses its running temperature is very much higher than that of the cylinder block. However, since the valve is also governing the distribution of the cool intake charge its temperature will never rise to a level where there is a danger of seizure due to the elimination of the running clearance.

Since the valve receives the direct heating effect of the hot exhaust gasses and because the warm-up rate for aluminium alloy cylinder blocks or heads is rapid the relative rates of expansion are not too dissimilar.

In one embodiment the valve body may be supported between bearings at either end to reduce friction and maintain a controlled clearance between the valve and its housing. The valve body member may be made of any suitable ceramic, one example of which is silicon nitride. Due to the use of ceramic no lubrication is necessary especially when the valve body is supported between bearings.

The valve may be located in or associated with either the cylinder block or the cylinder head depending upon the design of the engine. When arranged to rotate between bearings the valve does not contact the housing in which it is located when cold. A small running clearance of the order of 0.01 to 0.03 mm per 25 mm of valve diameter may be provided. The clearance is also dependant upon the housing material.

According to a second aspect of the present invention there is provided an internal combustion engine having a rotary valve according to the first aspect.

In order that the present invention may be more fully understood examples will now be described with reference to the accompanying drawings, of which:

Figure 1:
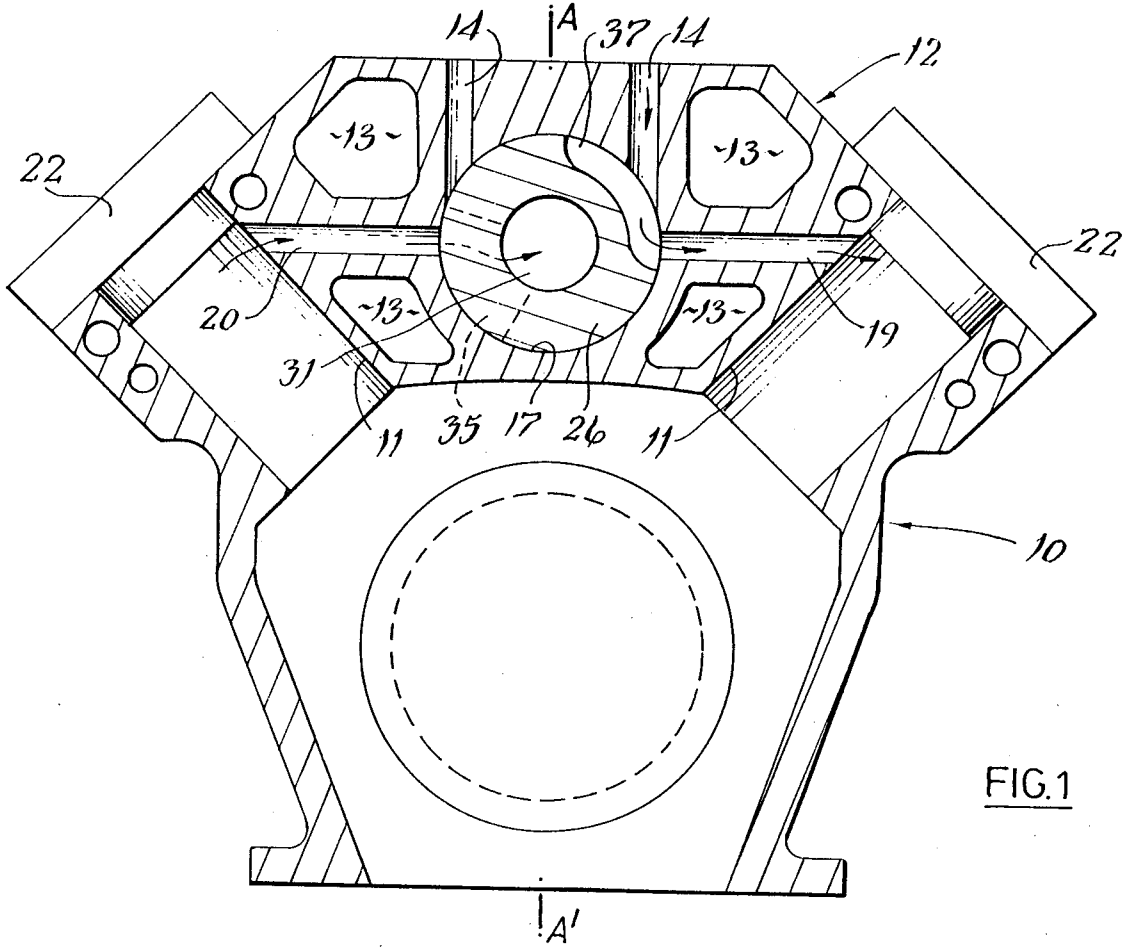
FIG. 1 shows a compound section about the line AA' through cylinders 1 and 2 of a V-8 engine according to the present invention.
Figure 2:
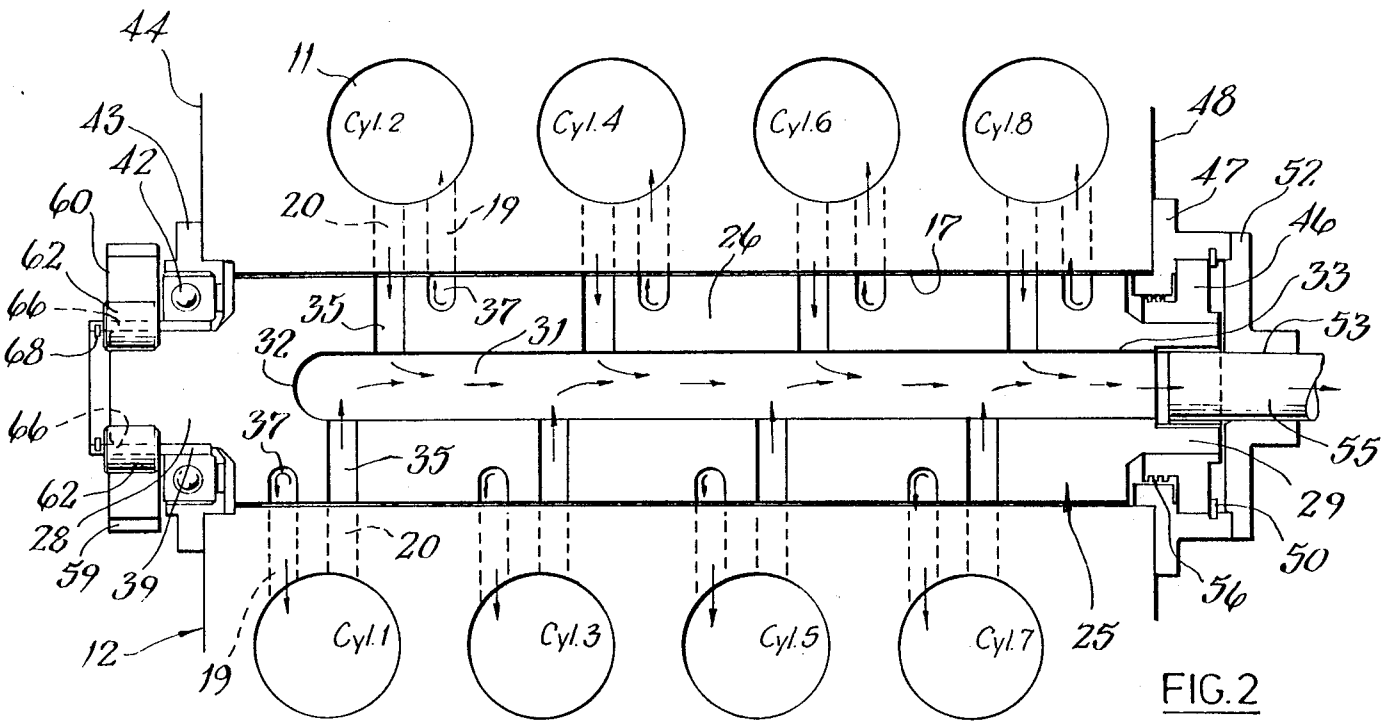
FIG. 2 shows a section in plan view through a rotary valve according to the present invention in the engine of FIG. 1.
Figure 3:
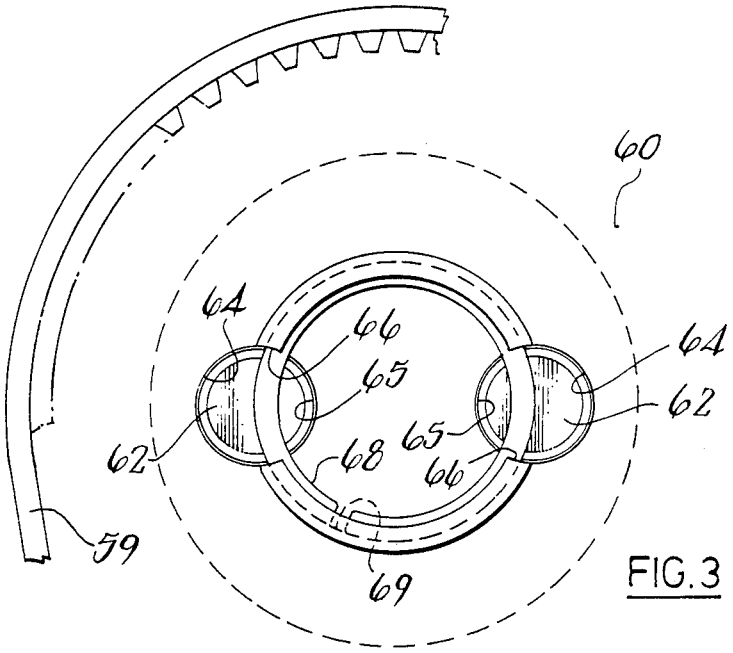
FIG. 3 shows a front elevation of a drive mechanism to the rotary valve of FIGS. 1 and 2.

Referring now to FIGS. 1 to 3 and where the same features are denoted by common reference numerals.

An engine cylinder block is shown generally at 10. The block is of 90° V-8 configuration in aluminium alloy having cylinders 11 and an integral manifold portion 12 having water cooling passages 13, inlet ducts 14 from multiple carburettors (not shown), a housing bore 17 and inlet ports 19 leading to the cylinders 11. Exhaust ports 20 leading from the cylinders 11 to the housing bore 17 are also provided. Each cylinder 11 has one inlet port 19 and one exhaust port 20. Each bank of cylinders is provided with a cylinder head 22. Also provided are pistons, connecting rods and a crankshaft (which are not shown). In the housing bore 17 is a rotary valve 25 which comprises a substantially cylindrical body portion 26 having reduced diameter portions 28 and 29 at each end. An internal passage 31 closed at one end 32 and open at the other end 33 is provided. Communicating with the passage 31 are exhaust ducts 35 passing through the wall of the valve 25. The exhaust ducts 35 periodically communicate with the exhaust ports 20 as the valve 25 rotates. Formed in the outer wall of the valve are inlet channels 37 which periodically provide a gas path between the inlet ducts 14 and the inlet ports 19. On the reduced diameter portion 28 is a shrink-fitted metal sleeve 39 having an interference fit therewith. The inner race of a rolling element bearing 42 supports the valve at the reduced portion 28, the outer race being retained and supported by a housing 43 which is attached to the end face 44 of the manifold 12. The opposite end 29 of the valve is supported by a carbon bearing 46 which is itself supported in a housing 47 which is attached to the opposite end face 48 of the manifold 12. The bearing 46 is axially retained by a circlip 50. The portion 29 is able to both rotate and to slide axially to accommodate thermal expansion in the bearing 46. A plate 52 having a flanged aperture 53 is attached to the housing 47. A pipe 55 to lead the exhaust gases away from the passage 31 is fixed to the aperture 53. Grooves 56 are provided in the bearing 46 to form a labyrinth seal to minimise pressure fluctuations due to exhaust gases between the bore 17 and outer diameter of the valve 25. Drive to the valve 25 is provided by a toothed belt 59 to cogwheel 60 which is a tight fit on the outer diameter of the sleeve 39. Drive is transferred from the wheel 60 to the reduced portion 28 by means of two cylindrical rollers 62 which are located in bores which are composed of scallops 64 in the cogwheel 60, scallops 65 in the portion 28 and axially extending notches 66 in the sleeve 39. The rollers 62 are axially retained by a circlip 68 in a groove 69 in the end of the sleeve.

The engine is also provided with ignition equipment such as a distributor, spark plugs etc. (which are not shown) for a gasoline powered engine.

The valve 25 is driven at half engine speed for a four-stroke cycle. The inlet and exhaust timing may be varied over very wide limits.

Axial expansion of the valve body is accommodated by the carbon bearing 46. Since no lubrication of the valve is necessary the valve itself does not contribute to the overall oil consumption of the engine.

It will be appreciated that the carburettors may be replaced by a fuel injection system and that other items may be substituted. For example, the valve may be driven by a gear and chain mechanism whilst means other than the rollers 62 and co-operating scallops 64,65,66 may be devised to provide positive, slip-free drive without imposing unnecessarily high stresses upon the ceramic material.

A rotary valve as described may replace the camshaft and, for example, in a pushrod overhead valve engine the tappets, pushrods, rockers, valves, valve springs and associated retainers, valve guides and valve seat inserts. In addition to the considerable savings which may accrue from the elimination of the above components the construction of the cylinder heads themselves may be greatly simplified. The conventional exhaust manifold may also be dispensed with.

Figure 4:
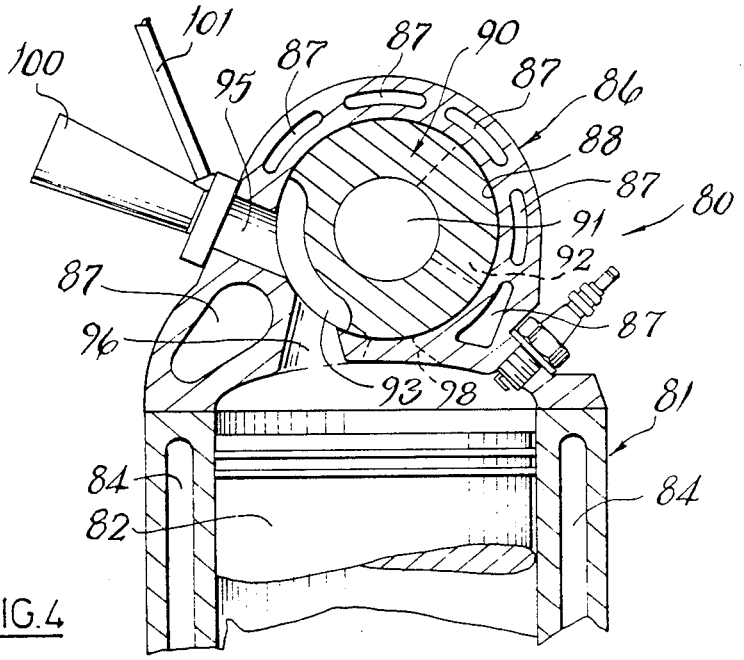
FIG. 4 shows a section through a cylinder and cylinder head of an engine having a rotary valve.

FIG. 4 shows a cross-section through a cylinder of a 4-cylinder in-line engine depicted generally at 80. The engine comprises a cylinder block 81 having pistons 82 and the usual connecting rods (not shown), crankshaft (not shown), and water coolant channels 84. The engine has a cylinder head 86 also having water coolant passages 87. The head 86 has a bore 88 having therein a rotary valve 90. The valve 90 has a central internal passage 91 having exhaust ducts 92 and inlet channels 93 formed therein in the same manner as described with reference to FIGS. 1 and 2. The valve causes inlet ducts 95 to periodically communicate with inlet ports 96 as the valve 90 is rotated. The exhaust duct 92 similarly behaves in causing the exhaust port 98 (shown as a dotted line) to periodically communicate with the internal passage 91 as the valve is rotated. The inlet ducts 95 have air intake trumpets 100, fuel injectors 101, conventional associated fuel control (not shown) and ignition equipment (not shown). Means for supporting and sealing the valve within the cylinder head 86 are essentially as described with reference to FIG. 2. Similarly the drive means to the valve may also be as described with reference to FIG. 3.

The invention has been described above with reference to spark ignition engines, the invention is, however, applicable also to compression ignition engines.

In V-configuration engines it is within the scope of the invention to employ two rotary valves, one being employed for the inlet and exhaust functions of each bank of cylinders.

I claim:

1. A rotary value for gas-aspirated reciprocating piston equipment, the value comprising a generally cylindrical value body member of a ceramic material, the body having an axially extending internal exhaust passage, the passage being closed at one end and open at the opposite end, at least one exhaust duct passing in a generally radial direction through the value body so as, when mounted in such reciprocating piston equipment, to permit exhaust gas from an associated cylinder to communicate intermittently with said internal exhaust passage, and at least one channel formed in the outer surface of said value body so as, when mounted in such reciprocating piston equipment, to permit intermittent entry of inlet gas into the associated cylinder, whereby, in use exhaust gas passing through said exhaust passage heats and thermally expands said value body member so as to tend to maintain a small positive clearance thereabout.

2. A valve according to claim 1 wherein said internal passage is substantially coaxially disposed with regard to the outer diameter of the valve.

3. A valve according to claim 1 wherein said ceramic material is silicon nitride.

4. In combination, an engine having a rotary valve according to claim 1 mounted therein with a small positive cold clearance, the thermal expansion of the valve body member relative to the thermal expansion of the surrounding engine housing being such as to control the widening of said clearance so as to maintain effective gas sealing by said small clearance.

5. An engine according to claim 4 wherein the cold clearance between the outer surface of said valve and an associated housing is between 0.01 and 0.03 mm per 25 mm of valve diameter.

6. An engine according to claim 5 wherein the valve body is operated in the unlubricated condition in its associated housing.

7. An engine according to claim 4 wherein the total axial extent of said at least one channel, and hence the contact of inlet gas with said valve body, are substantially less than the axial extent of said exhaust gas passage and the contact of exhaust gas with said valve body.

* * * * *